US006428244B1

(12) United States Patent
Wall

(10) Patent No.: US 6,428,244 B1
(45) Date of Patent: Aug. 6, 2002

(54) CONNECTING ELEMENT FOR SHEET PILES

(76) Inventor: Georg Wall, Hans-Graessel-Weg, 20, D-81375, Munich (DE)

( * ) Notice: Subject to any disclaimer, the term of this patent is extended or adjusted under 35 U.S.C. 154(b) by 0 days.

(21) Appl. No.: 09/621,365

(22) Filed: Jul. 21, 2000

(51) Int. Cl.[7] ..... E02D 5/02; E02D 5/08

(52) U.S. Cl. ..... 405/279; 405/251; 405/274; 405/277; 405/278; 403/348; 52/282.2

(58) Field of Search ..... 405/70–72, 250, 405/251, 274, 276–281; 403/348, 391, 398; 52/282.2, 169.1, 169.7

(56) References Cited

U.S. PATENT DOCUMENTS

| | | | | | |
|---|---|---|---|---|---|
| 1,039,563 | A | | 9/1912 | Mathias | |
| 1,098,077 | A | | 5/1914 | Annison | |
| 1,681,593 | A | * | 8/1928 | Pahl | 405/279 |
| 1,806,967 | A | * | 5/1931 | Dougherty et al. | 405/278 |
| 2,388,297 | A | * | 11/1945 | Slaughter | 52/282.2 X |
| 3,820,299 | A | * | 6/1974 | Verholt | 52/282.2 |
| 4,296,582 | A | * | 10/1981 | Simpson et al. | 52/592.1 |
| 4,557,091 | A | * | 12/1985 | Auer | 52/282.2 |
| 5,292,208 | A | | 3/1994 | Berger | 405/281 |
| 6,042,306 | A | * | 3/2000 | Arndts et al. | 405/279 |
| 6,092,346 | A | * | 7/2000 | Even et al. | 405/274 X |
| 6,282,762 | B1 | * | 9/2001 | Wall | 24/573.09 |

FOREIGN PATENT DOCUMENTS

| | | | | |
|---|---|---|---|---|
| DE | 443556 | | 3/1925 | |
| DE | 3907348 | | 9/1990 | |
| DE | 19822997 | | 1/1999 | |
| EP | 348012 | * | 12/1989 | 405/274 |
| GB | 2071188 | * | 9/1981 | 405/277 |
| GB | 2131856 | * | 6/1984 | 405/278 |
| WO | WO9739193 | | 3/1997 | |

OTHER PUBLICATIONS

Bau–Maschine und Technik, Dipl–Ing. Fritz Brackemann, Building Machinery and Construction Methods, vol. 9, Sep., 1967, pp. 337–343.

Spundwand–Technik, Wall–Profile, C–Profil Fur Hoesch Z–Profile. Varia–el, Flexibel, Rentabel, Dec. 1999.

* cited by examiner

*Primary Examiner*—Heather Shackelford
*Assistant Examiner*—Jong-Suk Lee
(74) *Attorney, Agent, or Firm*—Milde & Hoffberg, LLP

(57) ABSTRACT

A connecting element for sheet piles, particularly to join two sheet piles at an angle to each other, which includes hook strips (2, 3), whereby the one hook strip (2) is shaped as a knob section that consists of a head (4) and a basically straight neck (5) leading to the other hook strip, and includes an approximately rectangular channel (6), and whereby at least one additional hook strip (3) is formed as a C-shaped claw with a jaw (8), so that an approximately oval interior cavity (7) is formed.

3 Claims, 5 Drawing Sheets

CONNECTING ELEMENT FOR SHEET PILES

BACKGROUND OF THE INVENTION

The invention is a connecting element for sheet piles.

Connecting elements for sheet piles are known in a number of shapes and designs. They serve to connect sheet piles of a pile wall to one another, especially when two abutting sheet piles of sheet pile walls are interconnected and extending at an angle to each other.

In general, two different locking systems enjoy wide use —the Larssen system and the knob-and-claw system, which are not compatible to each other. German Patent Publication No. DE-A1-39 07 348, FIG. 5 or 6 discloses connection elements which allow the different locking systems to be combined. In this regard, the connection elements include several hook strips or C-shaped claws into which the different locking systems may be inserted. Here, the hook strips or claws of the connection elements are excluded from use with the to be connected end of the locking system. It is not possible to use these hook strips to connect with the other locking system.

Moreover, the connecting elements are so configured that the sheet piles to be connected can only be connected at a relatively fixed angle to each other, so that a flexing of a sheet pile through a small angle is not possible. This requires a high degree of precision during the pile-driving of a sheet pile during the connection at an angle of abutting sheet piles, so that the connecting element can precisely engage the hook strip of the sheet pile being connected.

German Patent No. DE-PS 443 556 describes a connecting element for sheet piles that includes a C-shaped claw with a jaw whereby an additional hook strip is provided on the side opposite to the jaw. This connecting element also allows sheet piles of different types, e.g., Larssen and knob-and-claw systems, to be connected as shown in FIG. 3; however, here also the individual connecting elements (i.e., the claw and the hook strip) are adapted to the particular connection type so that a practical positive locking (shape mating) results between the hook strips of the sheet pile and the joining elements of the connecting element. Such a connection of sheet pile walls using this method is only possible at fixed angles.

German Patent Publication No. DE-A1-2 018 119 describes a connecting element known in the industry as the so-called Delta shape. This connecting element is used to connect Larssen-type sheet piles, and displays the properties of a small hook strip designed to be compatible with the hook strip of a sheet pile, as well as a second hook strip with a relatively large channel. A sheet pile may be positively coupled (shape mated) to the small hook strip and a second sheet pile may be extended at a greater angle within the larger hook strip so that the connection of a sheet pile at approximately a 45° is possible. However, using this connecting element, it is not possible to also engage sheet piles of the knob-and-claw type.

Additionally, a number of connecting elements with hook strips or C-shaped knobs are known (for example, see U.S. Patent Nos. 5,292,208; 6,092,346, 1,098,077 and 1,039,563. U.S. Pat. No. 6,092,346.

U.S. Patent No. 5,292,208 describes a connecting element for a special knob-and-claw system that may only be used with sheet piles of the same type, and the sheet piles may only be used at fixed angles because of the positive coupling (shape mating) with the connecting element.

International Patent Publication No. WO 97/39193 describes a connecting element with a C-shaped claw into whose trapezoidal interior a similarly-shaped knob of a sheet pile may be inserted to form a positive coupling, while on a hook strip connected with a C-claw a Larssen type sheet pile can be engaged. This also provides a positive coupling (shape mating) for both connecting elements so that the sheet piles may only be connected at fixed angles. Also, a special type of sheet pile is required for the connection to the C-claw. U.S. Patent No. 1,098,077 describes connecting elements that include several C-shaped claws arranged in a special geometric pattern. The claws include an approximately oval-shaped interior cavity into which a similarly-shaped knob of a special sheet pile may be inserted. The jaw of the claw has a width corresponding to the sheet pile between the two end knobs which create a positive coupling, but connection is again possible only at a fixed angle determined by the connecting element.

The U.S. Patent No. 1,039,563 discloses a V-shaped sheet pile that is suitable for the construction of columns. The sheet pile includes arc-shaped hook strips on its free ends into which the hook strip of a neighboring sheet pile may be inserted. The profile of the hook strips and openings are such that the connection of an adjacent sheet pile is possible within a certain range of angles. These sheet piles, however, are also special models that cannot be connected with standard Larssen-type or knob-and-claw sheet pile systems.

A general overview of other connecting elements, especially for commonly-used sheet piles, is given in the periodical Baumaschine und Bautechnik, Volume 9, 1967, pages 337 to 343.

SUMMARY OF THE INVENTION

The present invention solves the task of providing connecting element elements for two sheet piles that may be used with existing sheet pile shapes of the Larssen or knoband-claw type, and it allows interchanging of the connecting system or combining with existing connecting systems so that both knob and claw sections of knob-and-claw sheet piles, as well as Larssen joints, may be connected together. Additionally, series of sheet piles may be interconnected at various angles to one another.

According to the invention a hook strip of a connecting element may be created as a C-shaped claw with a jaw so that an approximately oval-shaped cavity is formed into which the hook strip of a Larssen-type or knob-and-claw sheet pile may engage. For this, the jaw of the C-shaped claw is located in the middle of the claw so that its width is less than about ⅓of the claw's height. The other hook strip is shaped to have a knob cross-section that may engage the corresponding claw whereby the opening of the knob section faces basically opposite to the direction of the C-shaped claw.

The smooth interior surface of the C-shaped claw largely surrounds the corresponding hook strip of the Larssen-type or knob-and-claw sheet pile to be connected, whereby in most cases a three-point contact and thereby sufficient interlocking is provided between the hook strip of the sheet pile to be connected and the C-shaped claw of the connecting element. This manner of gripping will surely prevent the connecting element from sliding out of the hook strip of a connecting sheet pile to be connected during the pile-driving of the sheet pile.

A further advantage of the invention is that a flexible angle of about ±45° may be realized within the C-shaped claw between the sheet pile to be connected and the pile wall while still providing a secure connection at all angles and reliably preventing the release of the hook strip during pile-driving.

For a full understanding of the present invention, references should now be made to the following detailed description of the preferred embodiments of the invention as illustrated in the accompanying drawings.

DESCRIPTION OF THE PREFERRED EMBODIMENTS

Figure 1:
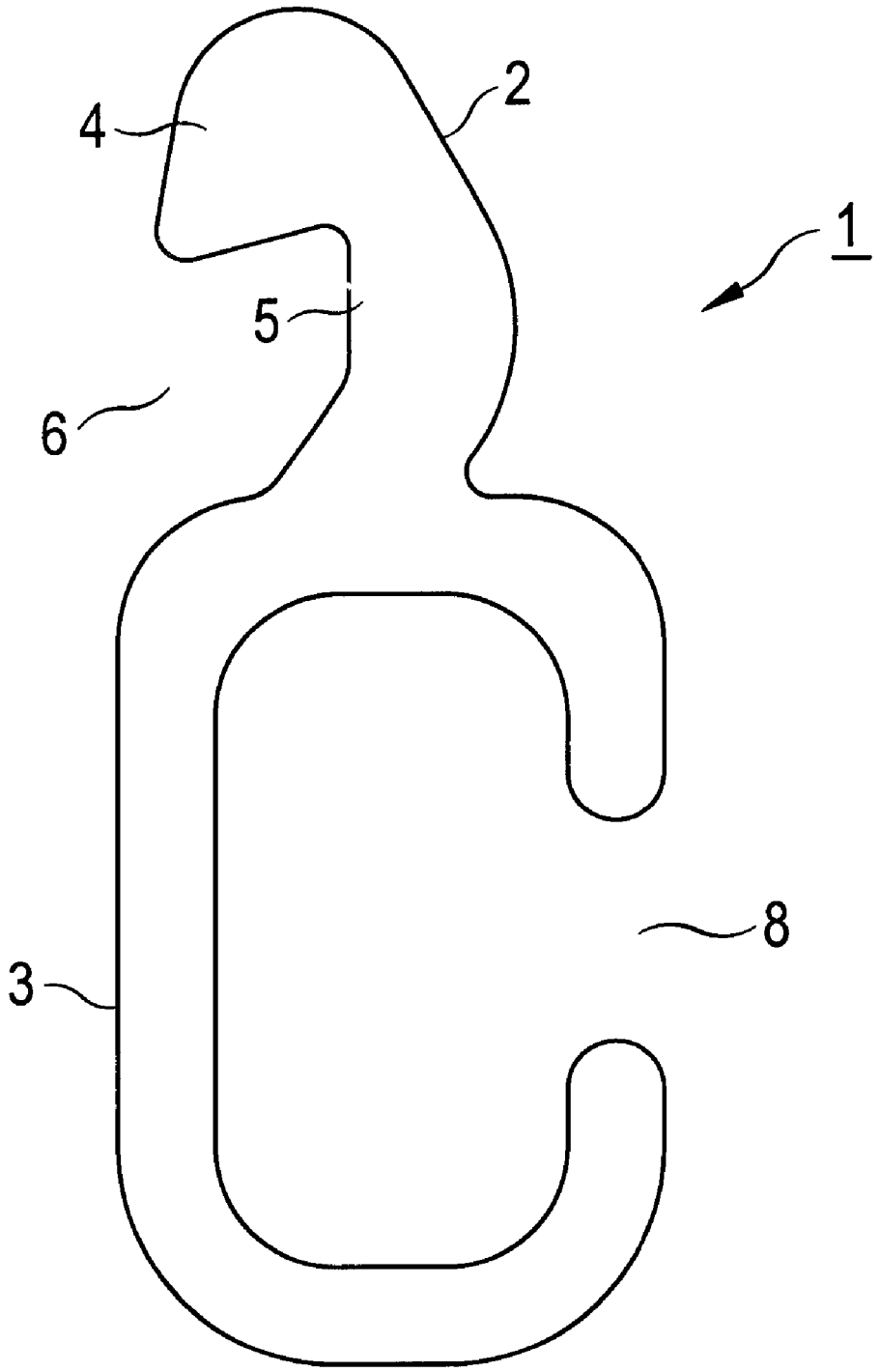
FIG. 1 shows a connection element for sheet piles based on the invention.

The preferred embodiments of the present invention will now be described with reference to FIGS. 1–6 of the drawings. Identical elements in the various figures are designated with the same reference numerals.

A connecting element 1 consists basically of two adjacent but directionally-opposed hooks 2 and 3 of differenct types.

As shown in FIG. 1, the first hood strip 2 is shaped as a knob section so that knob type sheet piles may grip into it. It consists of a knob or head 4, and of a neck 5 that leads to a second hook strip 3, and includes an approximately rectangular channel 6. The neck 5 of the hook strip 2 extends approximately parallel to an imaginary line connecting the two claw strips of the second hook strip 3 and along a line through the center of the claw. The second hook strip 3 is a C-shaped claw with a jaw so that an approxiamtely oval-shaped interior space is formed into which a Larssen-type or knob element may grip. For this, the jaw 8 of the C-shaped claw 3 is located at about half the height of the claw, but its width is less than about ⅓the claw's height. The jaw of the C-shaped claw is approximately opposite to the direction of the chanel 6 in the knob section 2.

Figure 2:
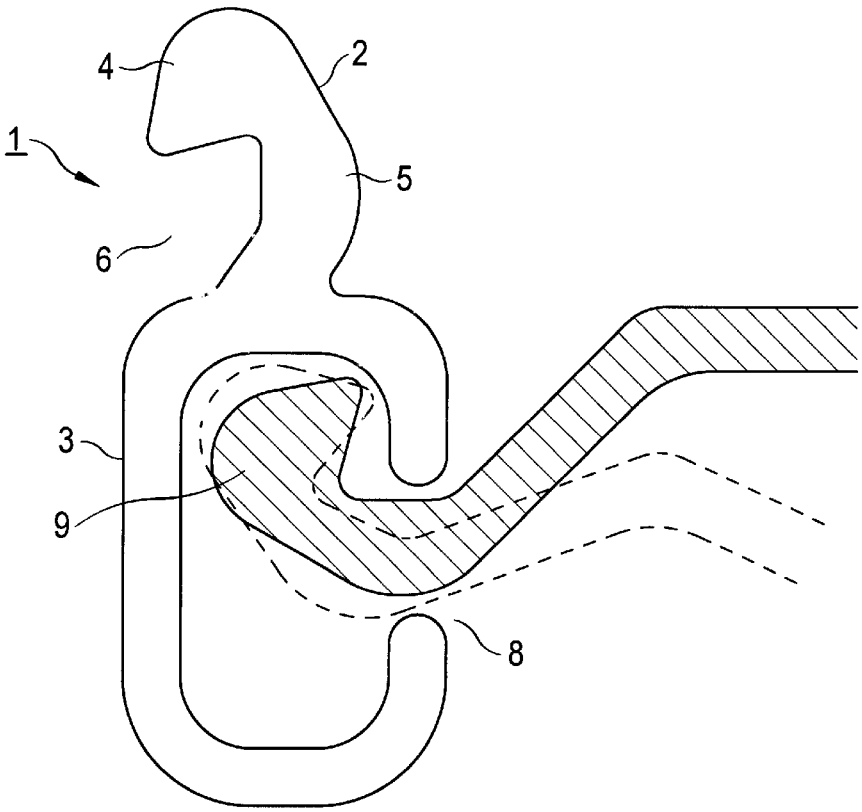
FIG. 2 shows the connecting element with a schematic representation of a knob-and-claw sheet pile connected with the knob engaged.

FIG. 2 shows schematically the connection between a knob-and-claw sheet pile with the knob 9 being engaged by the C-shaped claw 3. The connection angle of the sheet pile to be connected with the C-shaped claw may vary by ±45° from the pile wall so that a total possible pivot angle of 90° may result. Since the arrangement is symmetrical, the knob may also engage when its channel is facing in the opposite direction. This provides a high degree of variability and universality while providing a secure coupling between the sheet piles being connected.

Figure 3:
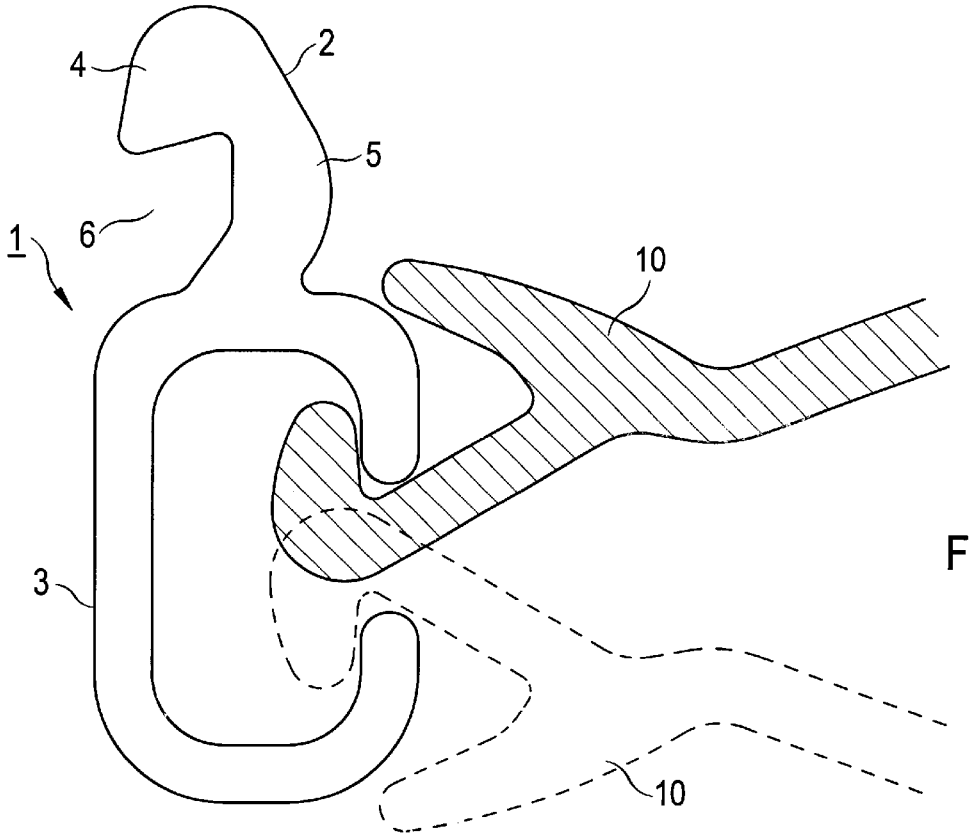
FIG. 3 shows the connecting element with a schematic representation of a knob-and claw sheet pile connected with the claw engaged.

FIG. 3 shows schematically the connection between a knob-and-claw sheet pile with the claw 10 being engaged by the C-shaped claw 3. As is visible from the diagram, the orientation of the claw section being connected is not relevant, and still allows the connection angle of the sheet pile with the C-shaped claw to vary by ±45° from the pile wall, resulting in a total possible pivot angle of 90°.

Figure 4:
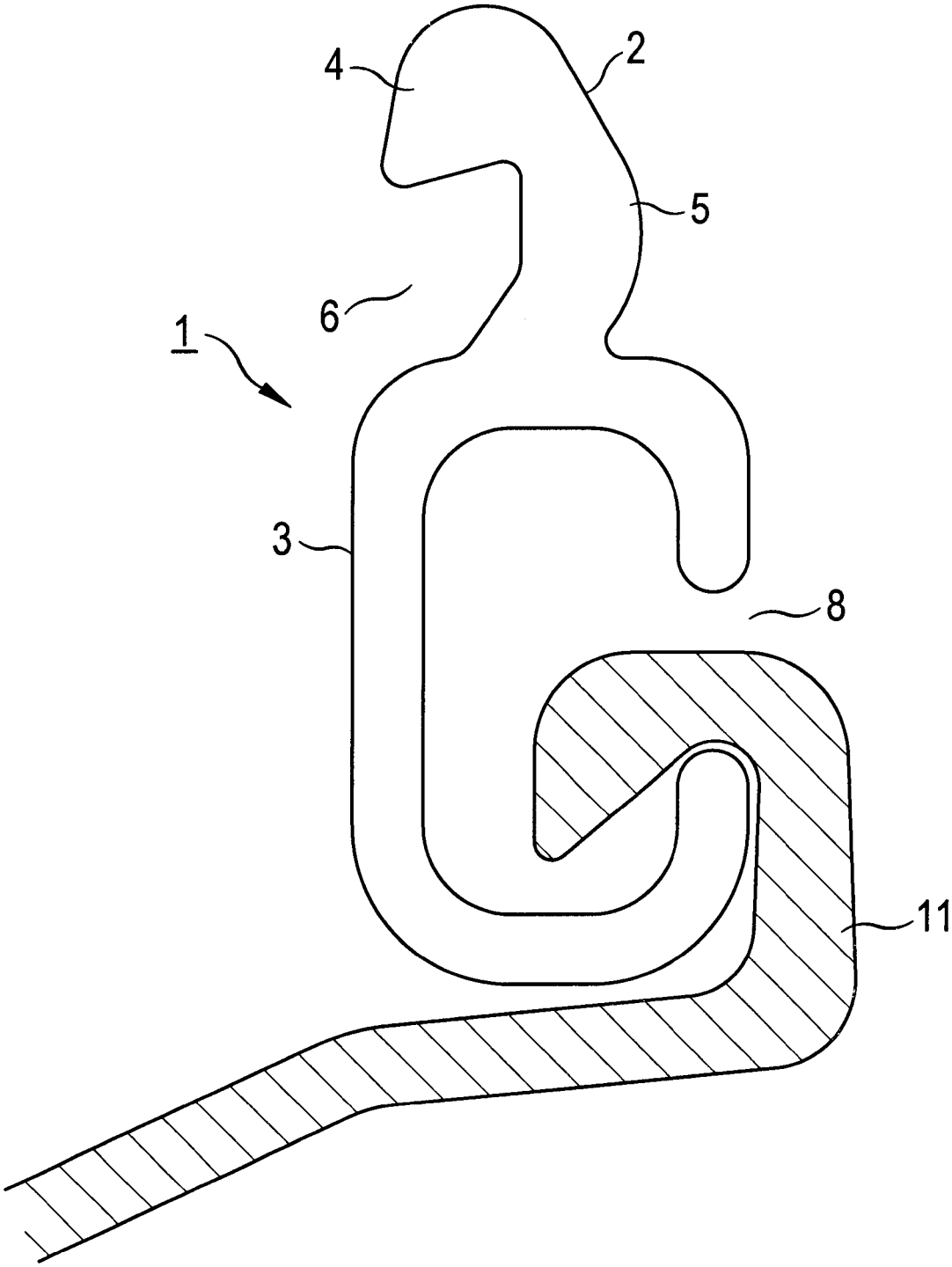
FIG. 4 shows the connecting element with a schematic representation of a connected Larssen-type hook strip.

FIG. 4 shows schematically the connection of a Larssen-type sheet pile 11, whereby the transition from the Larssen system to the knob-and-claw system is shown. Any Larssen-type sheet pile may be engaged by the C-shaped claw 3. Also, the connecting angle of the sheet pile to the C-shaped claw is variable. As is the case with the knob-and-claw system, the orientation of the Larssen section is not relevant.

Figure 5:
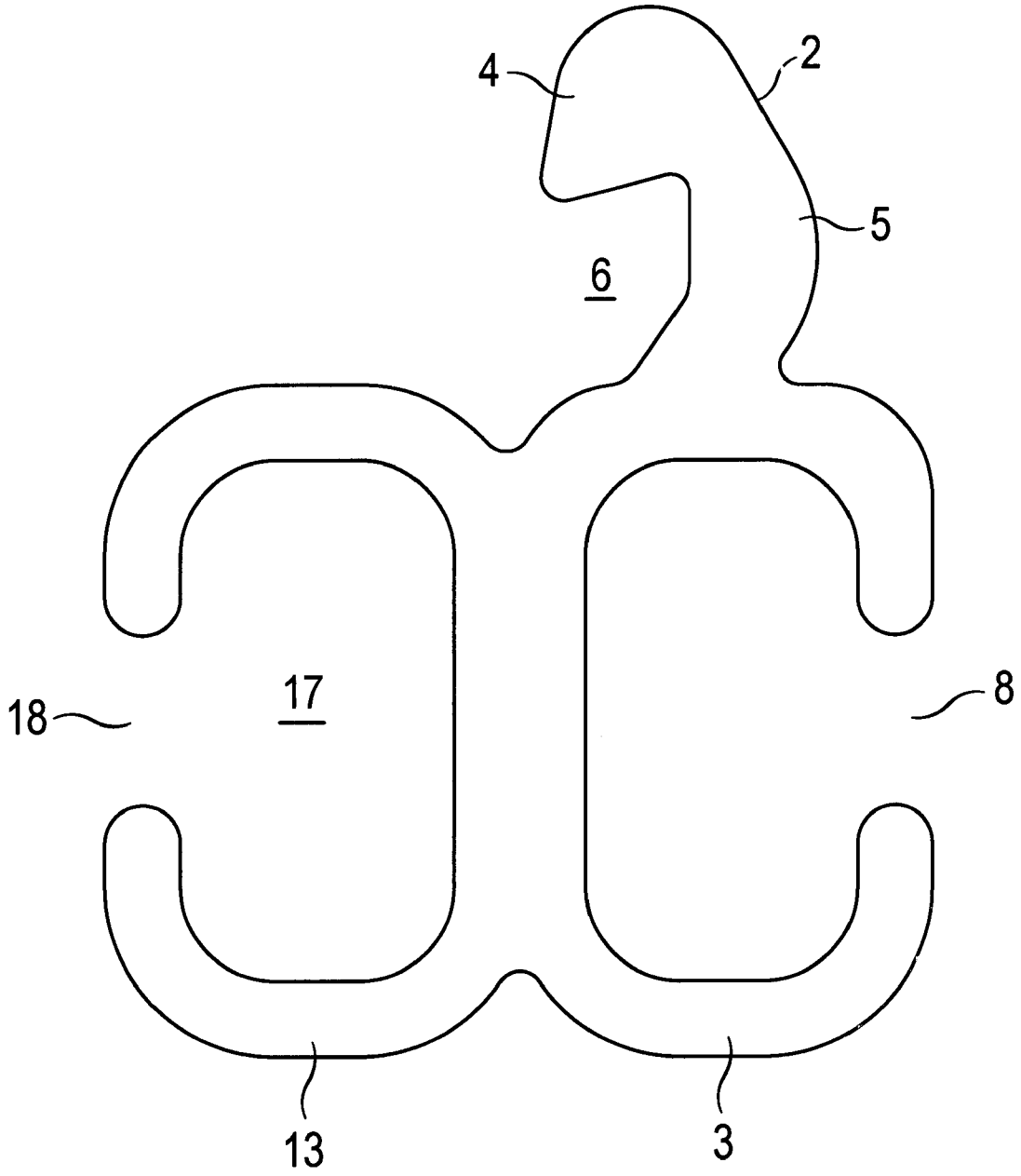
FIG. 5 shows a connecting element with a second C-shaped claw adjacent to the first C-shaped claw.

Within the scope of a further embodiment of the invention, shown in FIG. 5 an additional hook strip is provided that consists of a second C-shaped claw 13 with a jaw 18 so that an approximately oval-shaped interior space 17 is formed. This second C-shaped claw is directly adjacent to the first C-shaped claw but facing in the opposite direction.

Figure 6:
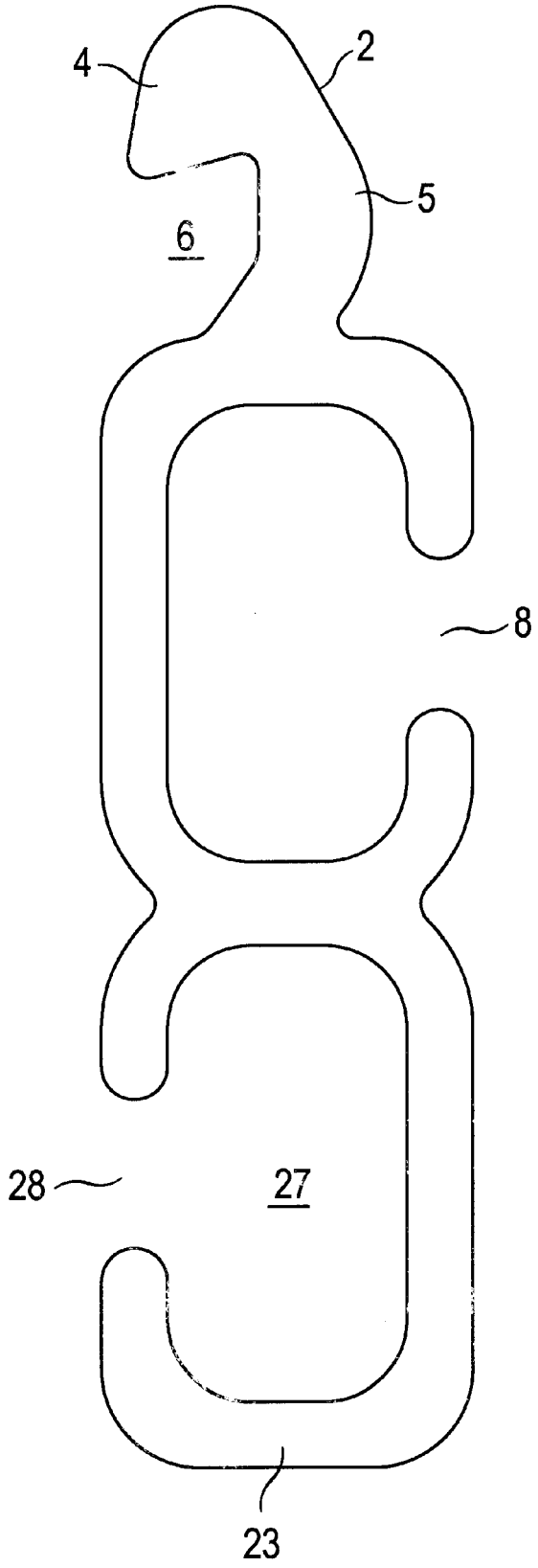
FIG. 6 shows a connecting element with a second C-shaped claw below the first C-shaped claw.

As shown is FIG. 6, an additional hood strip is provided directly below the second hook strip 3. This hook strip also consists of a C-shaped claw 23 facing in the opposite direction from the first C-shaped claw, and likewise has an oval-shaped interior space 27 with a jaw 28.

There has thus been shown and described a novel connecting element for sheet piles which fulfills all the objects and advantages sought therefor. Many changes, modifications, variations and other uses and applications of the subject invention will, however, become apparent to those skilled in the art after considering this specification and the accompanying drawings which discloses the preferred embodiments thereof. All such changes, modifications, variations and other uses and applications which do not depart from the spirit and scope of the invention are deemed to be covered by the invention, which is to be limited only by the claims which follow.

What is claimed is:

1. A connecting element for two sheet piles connected at an angle, comprising first and second hook strips, wherein the first hook strip is shaped as a knob section consisting of a head and a substantially straight neck connected to a top of the second hook strip and wherein the second hook strip is shaped as a first C-shaped claw with a jaw located at approximately half the height of the claw so that an approximately oval-shaped interior space is formed, the improvement wherein the first hook strip includes the head facing away from the neck to engage with a claw of a knob-and-claw sheet pile, wherein an approximately rectangular channel is located between the head and the neck, wherein two members of the first C-shaped claw forming the jaw are straight and aligned, so that the two members point toward each other, wherein the jaw of the first C-shaped claw has a width that is smaller than ⅓of the height of the claw, wherein the channel in the first hook strip faces the opposite direction from the jaw of the first C-shaped claw, and wherein the interior space and the jaw width are so dimensioned to engage different hook strips of the sheet piles to be connected and the connected sheet pile can be moved through a wide angle in the interior space of the first C-shaped claw while preventing disengagement of the hook strip at any angle.

2. The connecting element according to claim 1, wherein the neck of the first hook strip extends approximately parallel to an imaginery line passing through the two members of the first C-shaped claw and extends along a line through the center of the claw.

3. The connecting element according to claim 1, further comprising a second C-shaped claw that is connected directly to the first C-shaped claw, but with the jaws of the claws facing in opposing directions.

* * * * *